US006254206B1

(12) United States Patent
Petrick et al.

(10) Patent No.: US 6,254,206 B1
(45) Date of Patent: Jul. 3, 2001

(54) WIRE MANAGER

(75) Inventors: Matthew Petrick, Oak Park; James W. Brown, Willowbrook, both of IL (US)

(73) Assignee: Bretford Manufacturing, Inc., Franklin Park, IL (US)

( * ) Notice: Subject to any disclaimer, the term of this patent is extended or adjusted under 35 U.S.C. 154(b) by 0 days.

(21) Appl. No.: 09/249,897

(22) Filed: Feb. 16, 1999

(51) Int. Cl.[7] ..... A47B 13/02
(52) U.S. Cl. ..... 312/223.6; 108/50.02
(58) Field of Search ..... 248/68.1, 918; 312/223.6, 223.3, 194; 108/50.02, 50.01; 174/48, 49, 101

(56) References Cited

U.S. PATENT DOCUMENTS

| | | | | |
|---|---|---|---|---|
| 3,635,174 | * | 1/1972 | Ball et al. | 312/223.6 |
| 3,922,045 | * | 11/1975 | Meyer | 312/194 |
| 4,094,256 | * | 6/1978 | Holper et al. | 312/223.3 |
| 4,094,561 | * | 6/1978 | Wolff et al. | 312/223.6 |
| 4,163,867 | * | 8/1979 | Breidenbach | 312/223.6 |
| 4,296,981 | * | 10/1981 | Hildebrandt et al. | 312/223.6 |
| 4,323,291 | * | 4/1982 | Ball | 312/223.6 |
| 4,535,703 | | 8/1985 | Henriott et al. | 108/50 |
| 4,792,881 | * | 12/1988 | Wilson et al. | 312/223.6 |
| 4,827,850 | | 5/1989 | Diffrient | 108/60 |
| 5,103,741 | | 4/1992 | Grund et al. | 108/50 |
| 5,121,698 | * | 6/1992 | Kelley | 108/50.02 |
| 5,226,705 | | 7/1993 | Rorke et al. | 312/196 |
| 5,231,562 | * | 7/1993 | Pierce et al. | 108/50.02 |
| 5,272,988 | * | 12/1993 | Kelley et al. | 312/223.6 |
| 5,337,657 | | 8/1994 | Diffrient | 108/115 |
| 5,357,874 | * | 10/1994 | Palmer | 312/223.6 |
| 5,451,101 | * | 9/1995 | Ellison et al. | 312/223.6 |
| 5,606,920 | | 3/1997 | Meyer et al. | 108/50 |
| 5,640,912 | | 6/1997 | Diffrient | 108/50 |
| 5,715,761 | * | 2/1998 | Frattini | 312/223.6 |
| 5,934,201 | * | 8/1999 | Diffrient | 108/50.02 |
| 5,971,509 | * | 10/1999 | Deimen et al. | 108/50.02 |
| 5,998,732 | * | 12/1999 | Caveney et al. | 174/48 |
| 6,029,587 | * | 2/2000 | Rozier, Jr. et al. | 312/223.6 |

FOREIGN PATENT DOCUMENTS

| | | | | |
|---|---|---|---|---|
| 2020145 | * | 12/1971 | (DE) | 312/194 |
| 3337062 | * | 5/1985 | (DE) | 312/194 |
| 0010277 | * | 4/1980 | (EP) | 108/50.02 |
| 0307567 | * | 3/1989 | (EP) | 108/50.02 |
| 2406403 | * | 6/1979 | (FR) | 312/194 |
| 841466 | * | 7/1960 | (GB) | 312/194 |

OTHER PUBLICATIONS

Bretford Presentation Environments "PowerTrak and Power House"product brochure, Bretford Manufacturing Company, 7/97, 2 pages.

* cited by examiner

*Primary Examiner*—Ramon O. Ramirez
*Assistant Examiner*—Jon Szumny
(74) *Attorney, Agent, or Firm*—Wood, Phillips, VanSanten, Clark & Mortimer

(57) ABSTRACT

A wire manager for cables to electronic equipment on a table work surface. A bin with a removable cover is secured along an edge of the work surface. A bin divider defines longitudinally extending front and rear channels for power and data cables. Holes in the rear wall of the bin and in the cover adjacent the rear wall allow cables to be directed from the bin to electronic equipment on the work surface. The divider has a horizontal section spaced above the bottom wall of the bin to shield the data cables from power cables passing above the horizontal section to an opening and the work surface. The wire manager is mounted on bin supports secured to the underside of the work surface.

23 Claims, 3 Drawing Sheets

FIG. 1
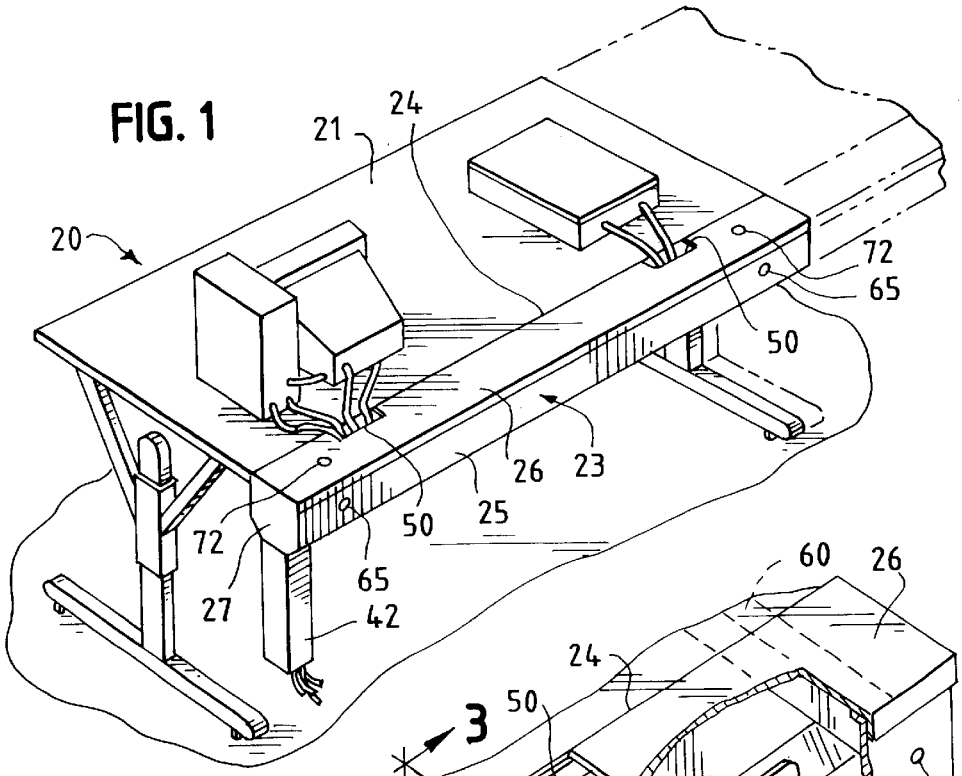
FIG. 2
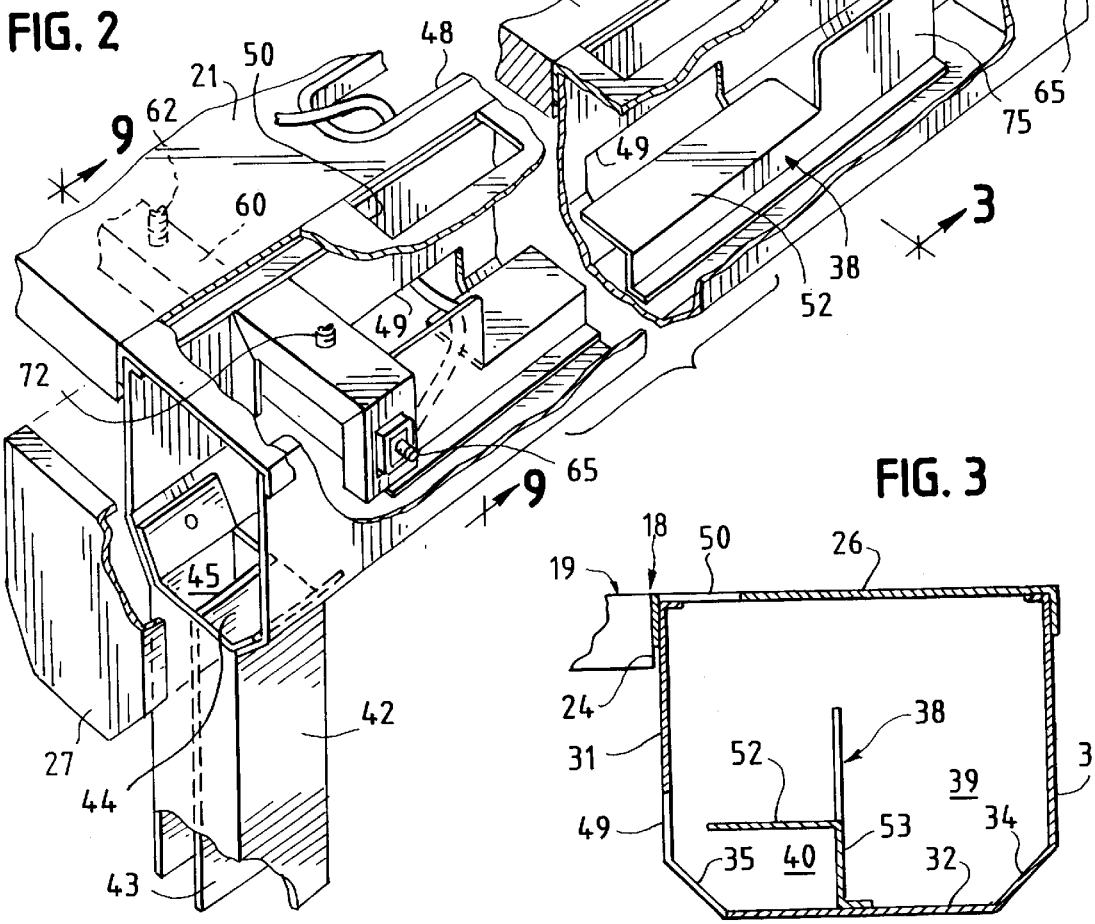
FIG. 3

WIRE MANAGER

CROSS REFERENCE TO RELATED APPLICATIONS

Not applicable.

STATEMENT REGARDING FEDERAL SPONSORED RESEARCH OR DEVELOPMENT

Not applicable.

BACKGROUND OF THE INVENTION

Electronic equipment widely used in offices, schools and the like is typically located on the work surface of a table and connected with multiple power and data cables. Wire managers have been proposed to contain, isolate and organize the cables. This application is concerned with a novel wire manager and a support which mounts the wire manager on the table work surface.

BRIEF SUMMARY OF THE INVENTION

The wire manager comprises an elongate bin of conductive material having spaced apart front and rear sidewalls, a bottom wall and an open top. A bin support secured to the table has the bin mounted thereon with a rear sidewall adjacent to and extending along the edge of the table work surface. A divider panel of conductive material between the sidewalls defines longitudinally extending front and rear channels, one for power cables and the other for data cables. A cover closes the open top of the bin. There is an opening in the rear sidewall or the cover through which cables are directed from the bin to the work surface of the table.

The divider panel is preferably mounted on the bottom wall of the bin and extends upwardly therefrom. The divider panel has a horizontal section spaced above the bottom wall of the data channel of the bin so that a power cable from the power channel extends over the horizontal section, out through the opening to the work surface of the table and is isolated by the horizontal section from a data cable.

Another feature of the wire manger is that a tube depends from and opens into the elongate bin, forming a chase which directs cables from below into the bin.

And another feature of the wire manager is that a bin support is secured to the underside of the work surface and extends outwardly of the table edge through the rear wall of the bin and is secured to the front wall of the bin.

Further features and advantages of the invention will be apparent from the following description.

BRIEF DESCRIPTION OF THE DRAWINGS

FIG. 1 is perspective view of a table and electronic equipment with the wire manager;

FIG. 2 is an enlarged, fragmentary perspective view of a table work surface and wire manager bin with the cover partially broken away;

FIG. 3 is a section taken along line 3—3 of FIG. 2;

DETAILED DESCRIPTION

Figure 4:
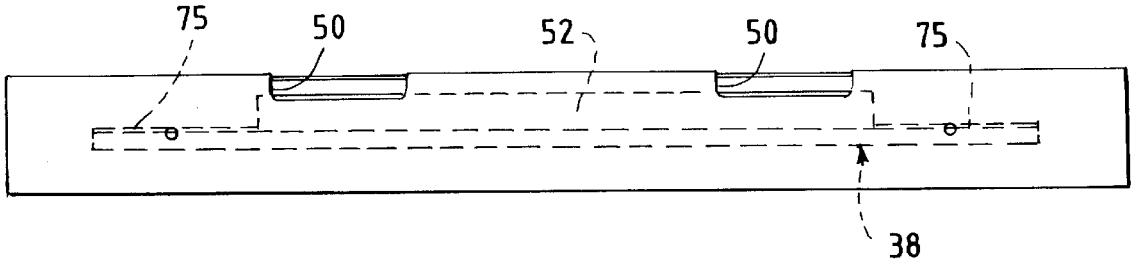
FIG. 4 is a plan view of the wire manager.

A typical electronic equipment installation is shown on table 20, FIG. 1. Electronic units, as a computer, facsimile machine, printer, document scanner or the like are arrayed a top side 19 of the table work surface 21. Each unit is connected with a power cable and one or more data cables.

As shown in FIGS. 1–3, a wire manager 23 is mounted along an upper exterior corner 18 formed by the intersection of the top side 19 of the work surface 21 and an edge 24 of the table work surface 21. Both the edge 24 and the upper exterior corner 18 extend from one end of the table to the other. The wire manager comprises a bin 25, removable cover 26 and end cap 27. Bin 25 is formed of conductive sheet metal, as steel, and has spaced apart front and rear sidewalls 30, 31, a bottom wall 32, and a open top, FIGS. 2 and 3. The sidewalls 30, 31 are joined with bottom wall 32 by chamfer corner walls 34, 35. A divider panel 38, also steel, is mounted on bottom wall 32 and extends upwardly between the sidewalls defining longitudinally extending front and rear channels 39, 40 for power and data cables, respectively.

A rectangular tube 42 depends from bin 25 and terminates above the floor, as shown in FIG. 1, providing a chase which directs power and data cables from below into the bin. The power and data cables are connected with power and data sources (not shown) as wall or floor junction boxes; and may be hardwired for permanent installations or plugged into jacks or sockets for temporary installation. A conductive divider panel 43 in chase tube 42 defines channels 44, 45 which open into the power and data channels, 39, 40, respectively, of the bin. A detailed showing of cables is omitted to avoid confusion in the drawings.

Openings are provided in the rear walls 31, 35 of the bin and along the rear edge of cover 26 adjacent table edge 24, through which cables are directed from the bin to equipment on the work surface 21 of the table. Where the table has a grommet opening 48, FIG. 2, cables are preferably directed through a bin wall opening 49, under the table work surface and up through the grommet opening. Alternatively, cables are directed through cover openings 50 to the table work surface 21 where the work surface has no grommet opening or if this location of the cable is more convenient.

Divider 38 has a centrally located horizontal section 52 extending rearwardly from the upwardly extending section 53 and spaced above the bottom wall 32 of the bin over data channel 40. The horizontal section 52 of the divider panel provides isolation for data cables in channel 40 from a power cable extending from channel 39 rearwardly to an opening 49 or 50.

Figure 5:
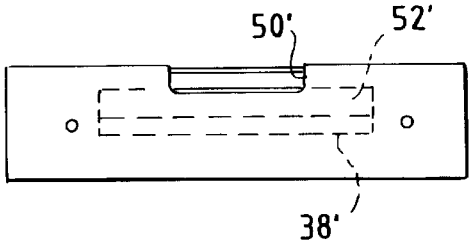
FIG. 5 is a plan view of another wire manager.

A wire manager for a table five or six feet long preferably has a divider with a horizontal section centrally located, as shown in FIGS. 2 and 4, with openings in the bin wall and cover adjacent the ends of the horizontal section. This accommodates electronic equipment placed anywhere on the associated table. A short wire manager, as for a filler panel between two spaced tables, might be two feet long, as shown in FIG. 5. Here, the divider 38' has a horizontal section 52' which extends the entire length of the divider. There is a single, centrally located opening 50' in the cover and a corresponding opening (not shown) in the rear wall of the bin.

Figure 6:
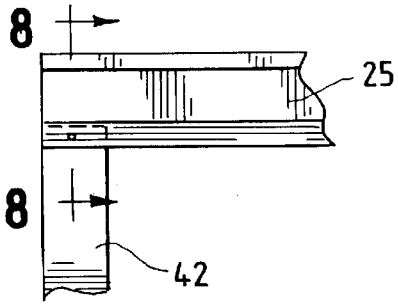
FIG. 6 is a fragmentary detail of the chase tube mounting.
Figure 7:
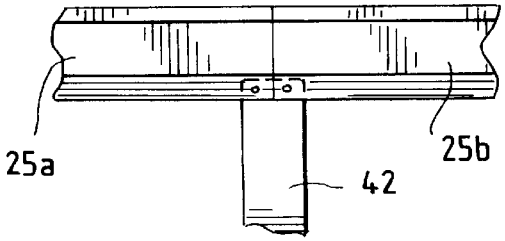
FIG. 7 is fragmentary detail of another chase tube mounting.

Wire chase tube 42 is preferably mounted at an end of wire manager bin 25 as shown in FIGS. 2 and 6. Where two tables are arranged end to end with wire managers 25*a*, 25*b* forming an extended wire manager, as shown in FIG. 7, chase tube 42 depends from and opens into the adjoining ends of both bins.

Figure 8:
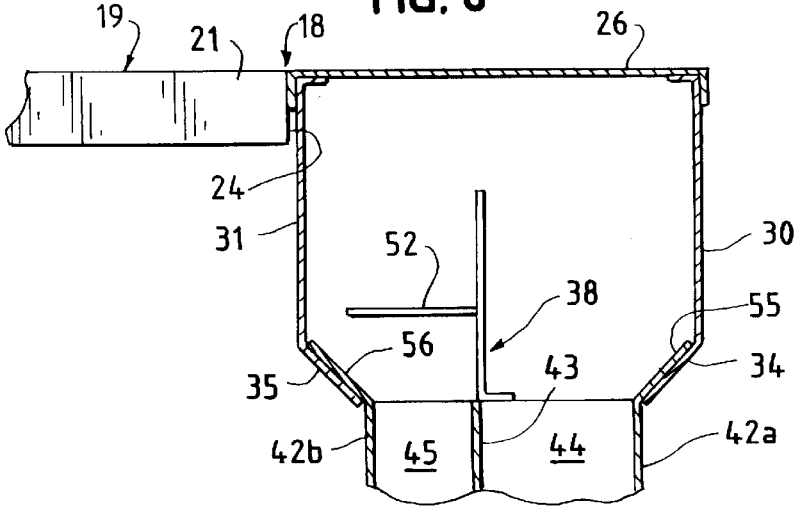
FIG. 8 is a section taken along line 8—8 of FIG. 6 showing the chase tube mounting.

Chase tube 42 has flanges 55, 56 which extend upwardly and outwardly from front and rear tube walls 42*a*, 42*b* and mate with chamfer corner walls 34, 35 of the bin, see FIG. 8.

Figure 9:
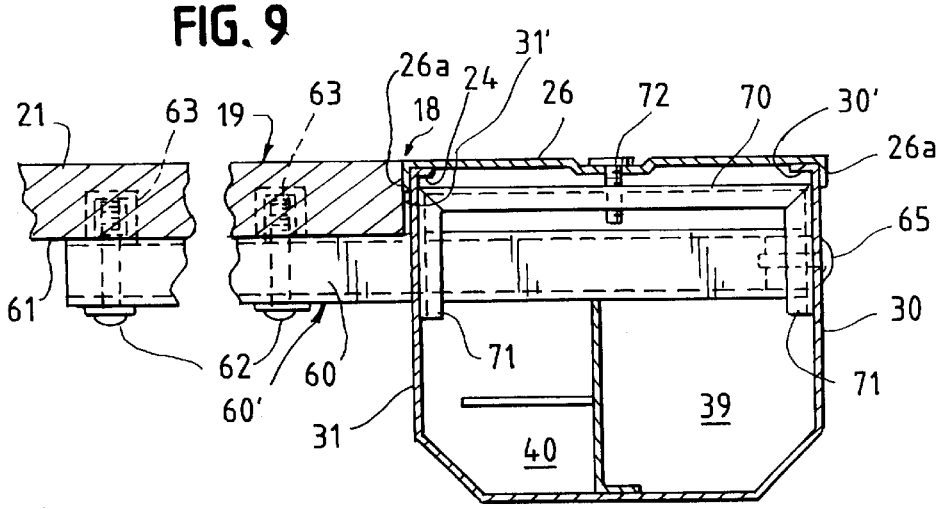
FIG. 9 is a section taken along line 9—9 of FIG. 2 showing the bin support.
Figure 10:
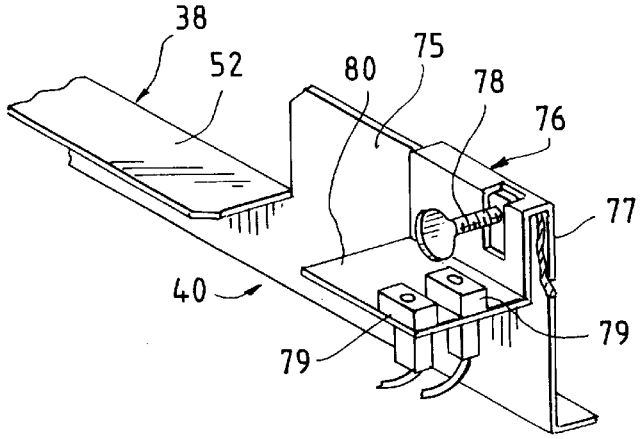
FIG. 10 is an enlarged detail showing a data jack plate mounted on the divider.
Figure 11:
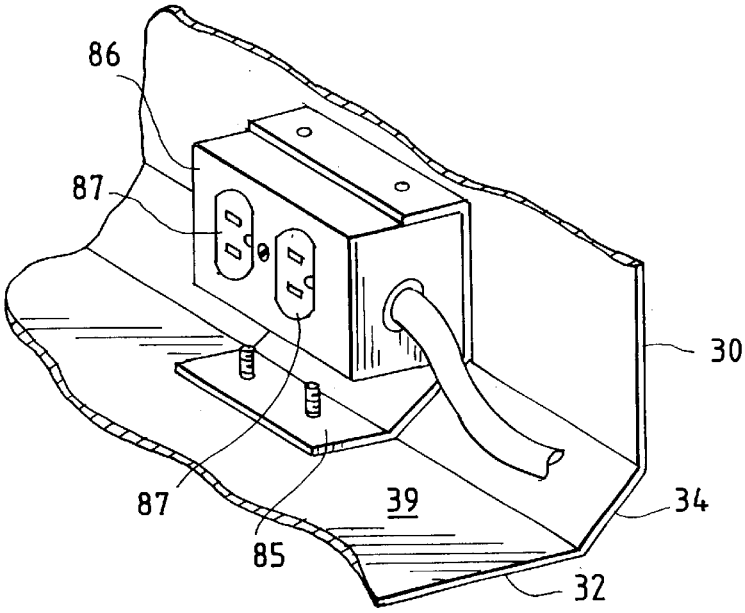
FIG. 11 is an enlarged detail showing a power receptacle mounted on a plate in the power channel.

Wire manager 23 is mounted along the edge 24 of the table work surface 21 by a pair of spaced apart bin supports 60. As seen in FIGS. 2 and 9, each bin support 60 includes a square tube 60' secured to the underside 61 of the work surface 21 as by bolts 62 threaded into anchors 63 embedded in the work surface. Each tube 60' extends outwardly of work surface edge 24 through a hole (not shown) in the rear wall 31 of bin 25. A bolt 65 secures the front wall 30 of bin 25 to the outer end of tube 60', securely mounting the bin on the table. A U-shaped cover retaining bracket 70, between bin walls 30, 31, has legs 71 through which tube 60' extends. Bin cover 26 is fastened to the base of U-shaped bracket 70 by a screw 72. Cover 26 has flanges 26*a* which overlap the upper edges 30', 31' of bin walls 30, 31. The length of support tube 60' and the spacing between legs 71 is such that the bin walls and cover flanges fit snugly together and with the edge 24 and upper exterior corner 18 of work surface 21.

The divider 38 in a long wire manager bin, as FIG. 4, has an end section 75 which extends vertically above horizontal section 52, at each end of the divider. A data jack carrier has a channel section 77 secured to the top of the divider end section as by screw 78. Data jack 79 mounted on horizontal carrier panel 80 affords a connection point for data cables (not shown) from equipment on work surface 21.

A power receptacle mounting plate 85 is shaped to conform with the bottom, chamfer and side walls of power channel 39. A power receptacle 86 with multiple sockets 87 is secured to mounting plate 85 and convenient for the user to plug in power cables of the equipment on work surface 21.

We claim:

1. A wire manager adapted for mounting on a table having a work surface including a top side and an edge intersecting the top side of the work surface to define an upper elongate exterior corner of the work surface, said wire manager comprising:

an elongate bin of conductive material having spaced apart front and rear sidewalls, a bottom wall and open top, said sidewalls each having an upper edge;

a divider panel of conductive material between the sidewalls, defining longitudinally extending front and rear channels, one for power and the other for data cables;

a cover for the open top of the bin adapted for attachment to the bin at the upper edges of said front and rear sidewalls, there being an opening in the bin or cover through which cables may be directed from the bin to the work surface of the table when the wire manager is mounted on the table; and a bin support affixed to and extending outward from said elongate bin and having a distal end adapted to be secured to the work surface for supporting the wire manager in a cantilevered fashion when the wire manager is mounted on the table with the top upper edge of the rear sidewall of the bin adjacent to and extending along the exterior corner of the work surface and the bin extending outward from said work surface away from said edge of said work surface.

2. The wire manager of claim 1 in which the bin sidewalls are vertical, the bin bottom wall is horizontal, and the sidewalls are joined with the bottom wall by chamfer corner walls.

3. The wire manager of claim 1 in which when the wire manager is mounted on the table the bin extends along the upper elongate exterior corner of the work surface with the cover substantially at the level of the top side of the work surface, the upper edge of the rear sidewall adjacent the upper elongate exterior corner of the work surface and the bottom wall below the top side of the work surface.

4. The wire manager of claim 3 in which the opening is in the rear sidewall, and is adapted to be below the work surface when the wire manager is mounted on the table.

5. The wire manager of claim 3 in which the opening is in the cover, and is configured to be adjacent the table edge when the wire manager is mounted on the table.

6. The wire manager of claim 1 in which the divider panel is mounted on the bottom wall of the bin and extends upwardly therefrom.

7. The wire manager of claim 6 in which the divider panel is centrally located on the bottom wall of the bin and has a horizontal section spaced above the bottom wall of the data channel of the bin.

8. The wire manager of claim 7 in which the front channel is for power cables, the rear channel is for data cables and the opening is in the rear wall of the bin or adjacent the edge of the work surface in the cover when the wire manager is mounted on the table and the horizontal divider panel section extends toward the rear wall for isolating a data cable in the data channel from a power cable extending over the divider panel section from the power channel and through said opening.

9. The wire manager of claim 7 in which the divider has an end section at an end of the horizontal section, which extends above the horizontal section.

10. The wire manager of claim 9 in which the divider has an end section at each end of the divider with the horizontal section extending between the end sections and there is an opening in the rear sidewall or cover adjacent each end section of the divider panel.

11. A wire manager for a table having a work surface with an edge, said wire manager comprising:

an elongate bin of conductive material having spaced apart front and rear sidewalls, a bottom wall and open top;

a bin support affixed to and extending outward from said elongate bin and having a distal end adapted to be secured to the table work surface for supporting the wire manager in a cantilevered fashion when the wire manager is mounted on the table with the rear sidewall adjacent to and extending along the edge of the table work surface;

a cover for the open top of the bin, there being an opening in the bin or cover through which cables may be directed to the work surface of the table; and a tube suspended and depending from and opening into the elongate bin, forming a chase which directs cables from below into the bin.

12. The wire manager of claim 11 in which said chase tube depends from an end of the bin.

13. Two wire managers as defined in claim 11, adapted to be aligned end to end when mounted on adjacent tables with said chase tube depending from and opening into the adjoining ends of the bins of both wire managers.

14. The wire manager of claim 11 including a divider panel of conductive material between the sidewalls of the bin, defining longitudinally extending front and rear channels, one for power and the other for data cables; and a conductive divider in said tube defining channels for power and data cables, the channel for power cables in the tube opening into the channel for power cables in the bin, and the channel for data cables in the tube opening into the channel for power cables in the bin.

15. The wire manager of claim 11 in which the bin sidewalls are vertical, the bin bottom wall is horizontal and the sidewalls are joined with the bottom wall by a chamfer corner wall; and the chase tube has flanges which mate with and are secured to the chamfer corner walls of the bin.

16. A wire manager for a table having a work surface including a top side, an underside, and an edge intersecting the top side of the work surface to define an upper elongate exterior corner of the work surface, said wire manager comprising:

an elongate bin having spaced apart front and rear walls, said walls each having an upper edge;

a bin support affixed to and extending outward from said elongate bin and having a distal end adapted to be secured to the work surface for supporting the wire manager in a cantilevered fashion when the wire manager is mounted on the table with the upper edge of the rear wall adjacent to and extending along the upper exterior corner of the work surface and the bin extending outward from said work surface away from said exterior corner; and a fastener securing the front wall of the bin to the bin support.

17. The wire manager of claim 10 in which the support has a flat surface for mating with the underside of the work surface.

18. The wire manager of claim 16 including:

a cover for the bin; and a second fastener securing the cover to the bin support.

19. The wire manager of claim 18 including a cover retaining bracket on said bin support, the second fastener being connected to said cover retaining bracket.

20. The wire manager of claim 19 in which said cover retaining bracket is a U-shaped plate with legs and a base, the support extending through the legs of the U and the second fastener being connected to the base of the U.

21. The wire manager of claim 16 having two bin supports, one adjacent each end of the bin.

22. A wire manager for a table having a work surface with an edge, comprising:

an elongate bin of conductive material having spaced apart vertical front and rear sidewalls, a horizontal bottom wall, chamfer corner walls joining the sidewalls to the bottom wall, and an open top;

a divider panel of conductive material between the sidewalls, defining longitudinally extending front and rear channels, one for power and the other for data cables;

a cover for the open top of the bin, there being an opening in the bin or cover through which cables may be directed from the bin to the work surface of the table when the wire manager is mounted on the table; and a bin support adapted to be secured to the table supporting the wire manager when the wire manager is mounted on the table with the rear sidewall adjacent to and extending along the edge of the table work surface such that the bin extends along the edge of the table work surface with the cover substantially at the level of the work surface, the rear sidewall adjacent the edge, the bottom wall below the work surface, and the opening is partially in the rear sidewall and partially in the chamfer corner wall.

23. A wire manager for a table having a work surface with an edge, comprising:

an elongate bin of conductive material having spaced apart front and rear sidewalls, a bottom wall and open top;

a divider panel of conductive material mounted on the bottom wall of the bin and extending upwardly therefrom centrally between the sidewalls, defining longitudinally extending front and rear channels, one for power and the other for data cables, the divider panel having a horizontal section thereof spaced above the bottom wall of the data channel of the bin, the divider panel also having an end section at an end of the horizontal section, which extends above the horizontal section;

a data jack carrier mounted on said divider end section, above the horizontal section;

a cover for the open top of the bin, there being an opening in the bin or cover through which cables are directed from the bin to the work surface of the table; and a bin support adapted to be secured to the table and supporting the wire manager when the wire manager is mounted on the table with the rear sidewall adjacent to and extending along the edge of the table work surface.

* * * * *